United States Patent [19]

Tobita et al.

[11] 4,184,347

[45] Jan. 22, 1980

[54] AUTOMATIC WASHING MACHINE

[75] Inventors: Hideyuki Tobita, Hitachi; Toshio Mori, Katsuta, both of Japan

[73] Assignee: Hitachi, Ltd., Japan

[21] Appl. No.: 4,225

[22] Filed: Jan. 17, 1979

[30] Foreign Application Priority Data

Jan. 25, 1978 [JP] Japan ..... 53-6153

[51] Int. Cl.[2] ..... D06F 33/02

[52] U.S. Cl. ..... 68/12 R; 68/207; 137/387; 364/104; 364/400

[58] Field of Search ..... 68/12 R, 207; 134/57 D, 134/113; 137/387; 364/104, 400; 307/141, 141.4

[56] References Cited

U.S. PATENT DOCUMENTS 3,835,880 9/1974 Hoffman et al. ..... 134/57 D X

FOREIGN PATENT DOCUMENTS 50-28171 3/1975 Japan ..... 68/12 R

*Primary Examiner*—Philip R. Coe

*Attorney, Agent, or Firm*—Craig and Antonelli

[57] ABSTRACT

An automatic washing machine in which an initial filling time required for filling a tub with water to a predetermined level at the start of a washing process is measured and stored in a memory, whereby time required for rinsing process is automatically determined on the basis of the measured initial filling time. Means is provided for determining the rinsing time duration on the basis of a preset rinsing time stored in the memory in place of the measured filling time when the latter is abnormally short, thereby to assure an adequate rinsing action.

3 Claims, 13 Drawing Figures

FIG. 3

| | CONTENTS OF PROGRAM \ PROCESS | WASHING WITH WATER | WASHING | RINSING | SPINNING |
|---|---|---|---|---|---|
| $S_1$ | REMOVAL OF HEAVY DIRT | STRONG | STRONG | STRONG | STRONG |
| $S_2$ | REMOVAL OF MEDIUM DIRT | STRONG | STANDARD | STANDARD | STRONG |
| $S_3$ | REMOVAL OF LIGHT DIRT | MEDIUM | SPARING | SPARING | MEDIUM |
| $S_4$ | WASHING OF SWEATERS | SOFT | SHORT | SPARING | SOFT |
| $S_5$ | WASHING OF SHIRTS | STRONG | STANDARD | STANDARD | SOFT |
| $S_6$ | WASHING OF DIAPERS | STRONG | SPARING | STRONG | STRONG |

FIG. 4

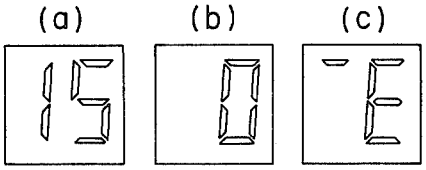

FIG. 5

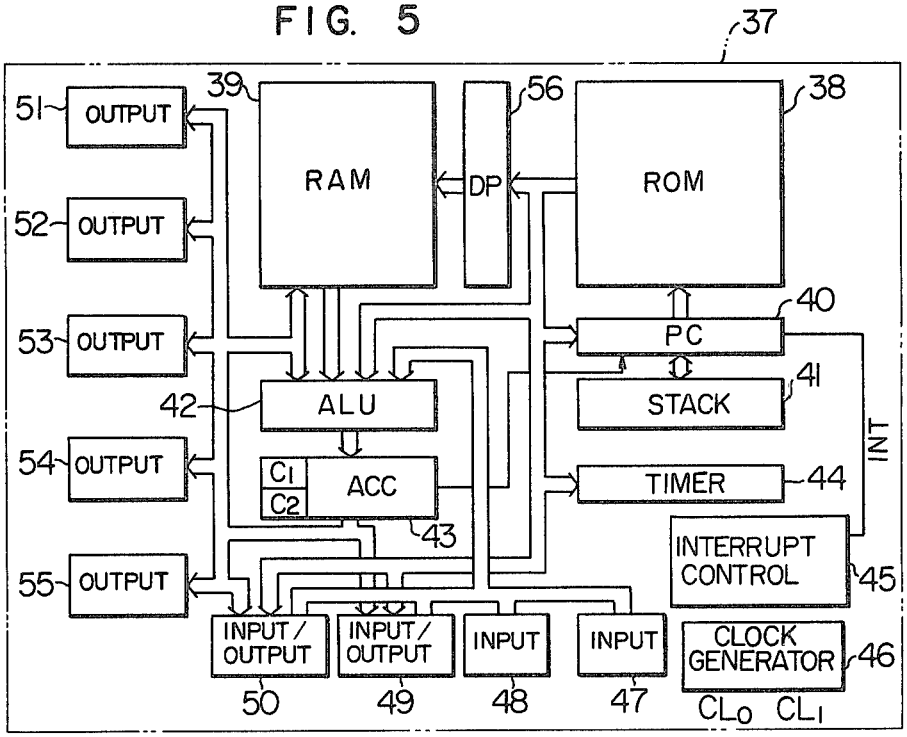

FIG. 6
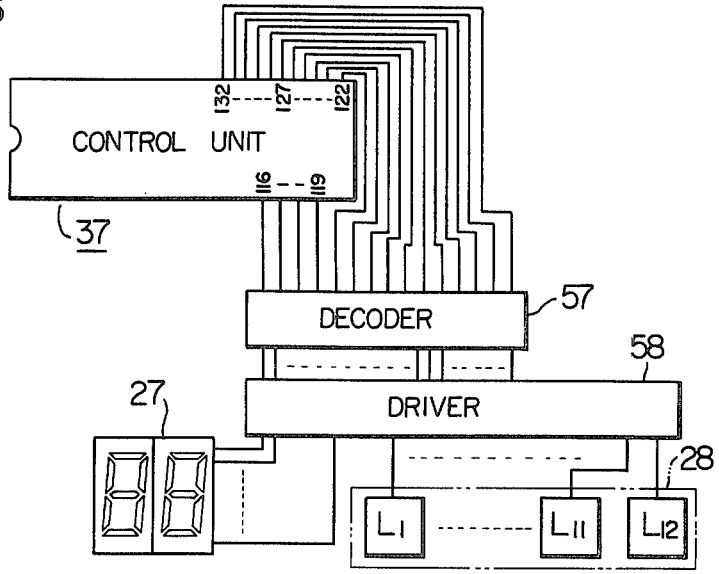
FIG. 7
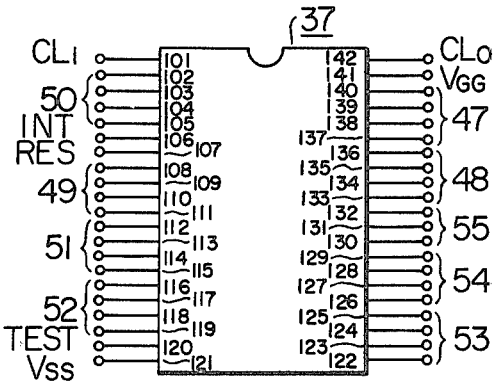
FIG. 8
| | PROCESS / STEPS | WASHING | RINSING | SPINNING |
|---|---|---|---|---|
| I | WASHING WITH WATER | ▨ | | |
| II | RINSING-TO-SPINNING | | ▨ | ▨ |
| III | WASHING-TO-RINSING | ▨ | ▨ | |
| IV | DRAIN / SPINNING | | | ▨ |
| V | AGITATION OF ADDITIVE | | ▨ | ▨ |

FIG. 9

| PROCESS / STEP / ITEMS | WASHING | | | RINSING | | | | | | | SPINNING | |
|---|---|---|---|---|---|---|---|---|---|---|---|---|
| | | | | SPINNING / RINSING | | | | FEEDING / RINSING | | | | |
| | FILLING | AGITATION | DRAIN | INTER-MITTENT SPINNING | SHOWERING /SPINNING | INTER-MITTENT SPINNING | FEEDING | FEEDING/ AGITATION | DRAIN | CONTINUOUS SPINNING |
| TIME | T | 10 MIN. | $t_2$ | 2.5 MIN. | $T_1$ | 2 MIN. | $t_{1a}$ | $T_3$ | $t_{2a}$ | 5 MIN. |
| PRESSURE SWITCH 34 | L→H | H | H→L | L | L | L | L→H | H | H→L | L |

AUTOMATIC WASHING MACHINE

The present invention relates to an automatic washing machine in which processes of washing, rinsing and spinning extraction are automatically carried out in accordance with stored programs. More specifically, the invention concerns an automatic washing machine of the above type in which an initial filling time required for filling a tub with water at the start of a washing process is measured and stored in a memory and a subsequent rinsing time duration is automatically determined on the basis of the measured filling time.

Heretofore, there has been proposed an automatic washing machine in which the time duration required for effecting the rinsing process is automatically determined on the basis of a filling time which is required for filling a tub of the washing machine with water to a predetermined level at the start of a washing process (refer to Japanese Patent Application Disclosure Publication No. 28171/1975). This type of the washing machine is apparently disadvantageous in that adequate rinsing action can not be attained when the filling time is abnormally short. For example, in the case in which water such as lukewarm used bathing water is charged into the tub of the washing machine in a so-called batch supply by using a bucket, the initial filling time described above will be abnormally shortened, involving a correspondingly shortened rinsing time insufficient for attaining an adequate rinsing action. Further, when such washing machine is used in a region or district where water pressure of a water supply source such as water service pipes is high, the filling time will become correspondingly shortened, involving an inadequate rinsing action.

Accordingly, an object of the invention is to provide an automatic washing machine in which a sufficiently long rinsing time can be assured even if the initial filling time is abnormally short.

In view of the above and other objects which will become more apparent as description proceeds, there is proposed according to the teaching of the invention the rinsing time is determined on the basis of a preset time stored in a storage in place of the measured filling time when the latter is abnormally short, thereby to assure an adequate rinsing operation.

The above and other objects, features and advantages of the invention will become more apparent from the description on exemplary embodiments of the invention taken in conjunction with the accompanying drawings, in which:

FIG. 3 illustrates contents of programmed washing operations and operation processes which can be selectively executed by a fully automatic operation program selector switch array of the washer shown in FIG. 1;

FIG. 4 illustrates examples of displays produced by an alphanumeric display device provided in the console panel shown in FIG. 2;

FIG. 5 is a functional block diagram of a control unit accommodated in a console box of the automatic washer shown in FIG. 1;

FIG. 6 is a functional block diagram of a display circuit controlled by the control unit shown in FIG. 5;

FIG. 7 shows an outer appearance of the control unit shown in FIG. 5;

FIG. 8 illustrates contents of programs which can be changed by a program selector switch array of the automatic washer shown in FIG. 1;

FIG. 9 illustrates more concretely the contents of a programmed operation selectably by means of the full automatic operation program selector switch array of the automatic washer shown in FIG. 1;

Figure 1:
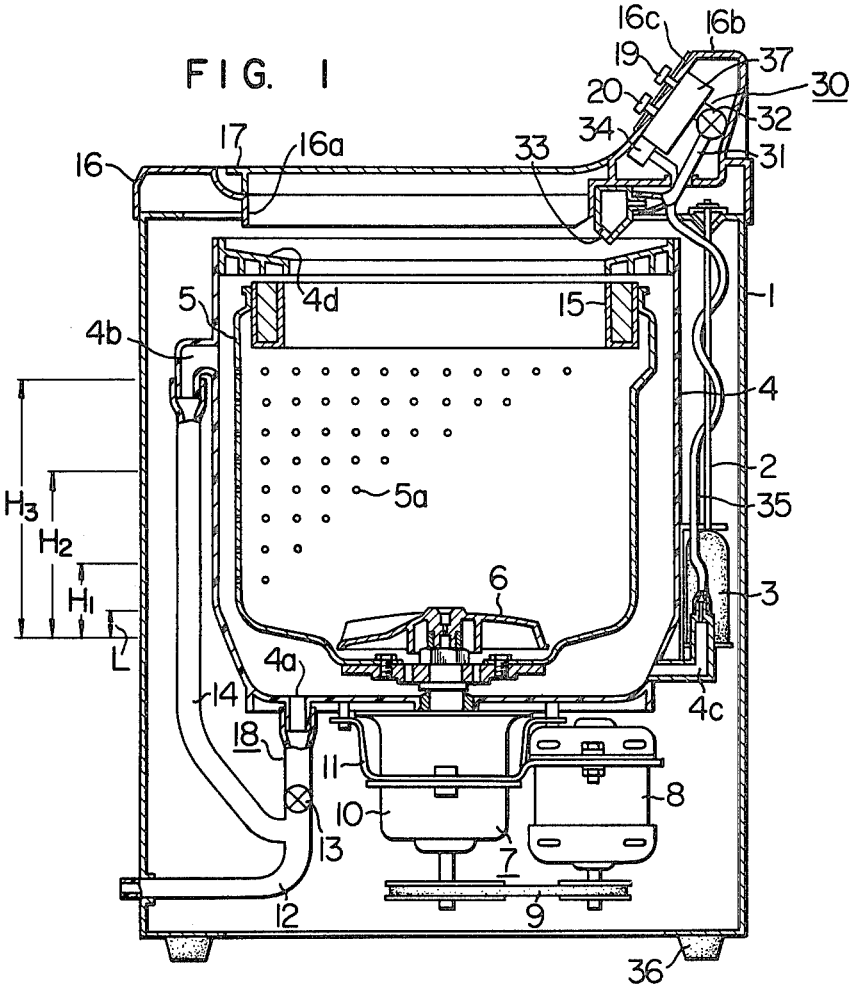
FIG. 1 is a vertical sectional view showing a main portion of an automatic washing apparatus according to an embodiment of the invention.

In the first place, reference is made to FIG. 1 showing an automatic washing machine to which the present invention can be applied. The washing machine comprises an outer housing or cabinet 1 made of a stainless steel or the like material in which an outer tub 4 of a synthetic resin material or steel sheet is disposed in a suspended state by means of suspending rods 2 and vibration buffer means 3 such as coil springs or elastic rubber members. Although only one set of the suspending rod 2 and the vibration buffer 3 is shown in the figure, it will be appreciated that four sets of them are provided to suspend the tub 4 in a satisfactory manner.

The outer tub 4 is destined to be filled with a washing liquid such as water and has a rotatable perforate basket 5 disposed concentrically therein. The basket tub 5 may be formed of a synthetic resin material or enamelled sheet metal and has a large number of apertures **5*a* for extracting water or washing liquid from clothes under a centrifugal force after a washing or rinsing process. In other words, clothes to be washed are received in the basket tub 5 to be agitated to remove dirt and finally centrifuged to remove more liquid from fabric after the rinsing process. For the purpose of washing and rinsing the clothes, an agitator or in the broader sense a pulsator 6 is rotatably provided at a bottom portion of the inner tub or basket 5. During the washing and the rinsing processes, the basket tub 5 is held stationary, while the pulsator 6 is rotated in one (normal) or the other (reverse) direction. At the spinning or centrifuging process for extracting water from the clothes under the centrifugal force, both the basket tub 5 and the pulsator 6 are rotated at the same speed in the same direction. The rotation of the basket tub 5 and the pulsator 6 is controllably effected by a drive unit 7**.

The drive unit 7 is composed of an electric motor 8, a transmission means 9 including a belt and pulleys for transmitting the rotation of the electric motor 8 to the pulsator 6 and/or the washing and centrifuging basket tub 5, a clutch mechanism 10 adapted to selectively rotate the pulsator 6 solely or together with the basket tub 5, and a brake mechanism (not shown) for stopping the rotation of the washing and centrifuging basket tub 5. The drive unit 7 is fixedly mounted on the outer bottom wall of the outer tub 4 by means of a supporting bracket 11 made of a steel plate.

The outer tub 4 is provided with a discharge outlet **4*a* for draining water from the tub 4, an overflow outlet port 4*b* for discharging water in excess during the process for rinsing with overflowing water and a pressure deriving port 4c for detecting pressure prevailing in the outer tub 4. Mounted on the inner wall of the outer tub 4 at the open top portion thereof is a cover plate 4d made of a synthetic resin, stainless steel sheet or the like for preventing the clothes or other things from falling into a space defined between the outer tub 4 and the basket tub 5. A drain system 18 including a drain conduit 12 and an electromagnetic drain valve 13 is provided below the bottom of the outer tub 4. The drain conduit 12 has one open end portion press-fitted onto the outlet pipe 4a and the other end portion extending exteriorly from the cabinet 1. An overflow discharge conduit 14 is connected to the overflow outlet pipe 4b at one end and to the drain conduit 12 at the other end. Water flowing into the overflow outlet port 4b is thus directly discharged to the exterior of the cabinet 1 by way of the overflow conduit 14 and the drain conduit 12 independently from operation of the electromagnetic drain valve 13. A balancing ring 15 is secured to the washing and centrifuging basket tub 5 at an inner top end portion thereof. Secured fixedly to the cabinet 1 at the top end thereof is a top cover member 16 of a synthetic resin or the like material in which there are formed an access opening 16a for allowing the clothes to be thrown into or taken out from the basket tub 5 and a console box 16b** for accommodating various electric and electronic parts therein.

A front part of the console box 16b is constituted by an operator control panel 16c which is provided with a water feeding opening 18, a buzzer switching knob 19, a water level switching knob 20, a main switch 21, a programmed operation selector switch array 22, a programmed process selector switch array 23, a start switch 24, a pause switch 25, a two-digit display device 27 for displaying a remaining run time and other items, twelve display lamps 28 for displaying the progress in the machine operation, and a display bar zone 29 for displaying the contents or types of six operations selected by the full automatic operation selector switch 22.

Referring again to FIG. 1, the water supply system 30 comprises a water feeding hose or conduit 31, an electromagnetic control valve 32 and a shower head 33. The water feed control valve 32 is installed within the console box 16b. Water fed to the inlet port 18 flows through the conduit 31, the control valve 32 and the shower head 33 into the outer tub 4.

The pressure switch 34 provided in the console box 16 is adapted to determine whether the tub 4 is filled with water to a predetermined level by detecting the pressure at a bottom portion of the outer tub 4. The pressure switch 34 may be composed of reed contacts, a magnet and a restoring spring. A tube made of vinyl 35 is connected between the pressure switch 34 and the pressure deriving port 4c for the pressure detection. Four elastic legs 36 are provided at an outer bottom wall of the cabinet 1.

With the aid of an operation program including six types of operations selected by button switches $S_1$ to $S_6$ of the full automatic operation program selector switch array 22, all of the washing process in which the clothes are agitated to remove dirt, rinsing process in which cleaning agent is removed from the clothes and the centrifuging or spinning process in which the clothes are centrifuged to remove more liquid from the fabric are executed, wherein at least one of those processes is different from the other in respect of the time duration required for the execution thereof.

Exemplary relationships between the programmed contents of operations and the types of processes cycles are shown in FIG. 3.

As can be seen from FIG. 3, the operation program consists of a first set of three contents, i.e. removals of heavy dirt, medium dirt and light dirt which can be selectively preset in dependence on the soiled degree or state of the clothes or the like things to be washed and a second set of three contents which are selected independence on the varieties or kinds of the clothes or fabrics to be washed such as sweater, shirts and diapers. In the exemplary case shown in FIG. 3, assumption is made such that the washing process is so preset as to be "strong">"standard">"sparing">"short" in terms of the time for which the pulsator 6 is required to be rotated for executing this process. On the other hand, the rinsing process is so preset in the same sense that "strong">"standard">"sparing". For the centrifuging or spinning process, the time duration is so preset as to be "strong">"medium">"soft".

It is possible to change the combinations of the washing process, rinsing process and the centrifuging process by means of the button switches I, II, III, IV and V of the process selector switch array 23. As is illustrated in FIG. 8, it is also assumed that when the button I is depressed, the washing solely with water is carried out. Depression of the button II allows only the rinsing process followed by the spinning process to be executed with the washing process being inhibited. Actuation of the button switch III will inhibit the spinning or centrifuging process, while allowing the washing process and the rinsing process to be carried out. With the button IV, only the spinning process is effected. When the button V is depressed, the washing process and a preceding half cycle of the rinsing process are inhibited, while the succeeding half cycle of the rinsing process and the spinning process are carried out. The programmed processes executed by depressing the button V is suited for adding a finishing agent to the clothes or the like and will be referred to as "additive agitating process". For the washing process with water solely as effected by actuating the button switch I, three types of water washing "strong", "medium" and "soft" can be accomplished by correspondingly setting the buttons $S_1$ to $S_6$ of the full automatic operation program selector switch array 22, as illustrated in FIG. 3. In this conjunction, the rotating time duration of the pulsator 6 is so preset that "strong">"medium">"soft".

Figure 2:
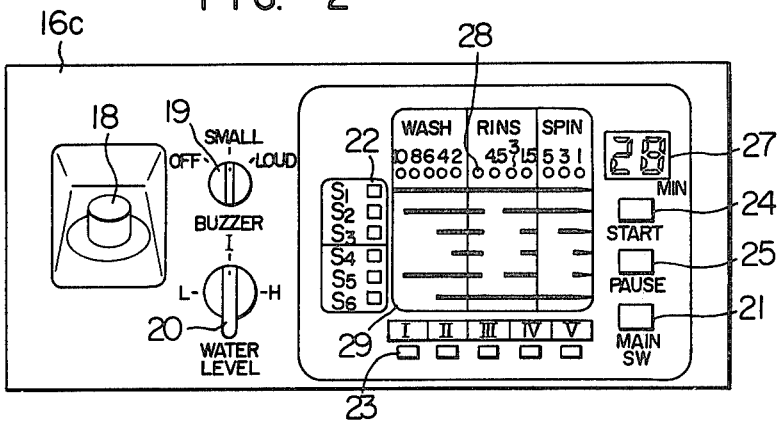
FIG. 2 is a plan view to show a console panel employed in the automatic washing machine shown in FIG. 1.

The main switch 21 serves for electrically connecting the washing machine to a power supply source such as a commercial power line. The progress display lamp array 28 for indicating the progress of the executed processes to operator or user comprises a first group of five lamps $L_1$, $L_2$, $L_3$, $L_4$ and $L_5$ for the washing process, a second group of four lamps $L_6$, $L_7$, $L_8$ and $L_9$ for the rinsing process and a third group of three lamps $L_{10}$, $L_{11}$ and $L_{12}$ for the spinning process. Each of these lamps $L_1$ to $L_{12}$ may be preferably constituted by a light emission diode in view of a long use life thereof. The buzzer knob 19 is used to change over the sound level produced by a buzzer (not shown) provided in the console box 16b among a high level, a low level and the off-state. The water level change-over knob 20 is manipulated to set the water level in the outer tub 4 at different levels. For example, when the knob 20 is set to a position labelled by "H" (FIG. 2), a liquid level $H_3$ (FIG. 1) is preset, while at the position "I" of the knob 20 a liquid level $H_2$ is preset and at the knob position "L" a liquid level $H_2$ is set.

Examples of alphanumeric displays as produced by the display devide 27 which is composed of light emission diodes are illustrated in FIG. 4. When the remaining run time is in the range of 14 to 15 minutes, digital display "15" is produced as shown in FIG. 4 at (a). On the other hand, numeric display "O" as illustrated at (b) represents that the remaining run time is within one minute. Further, when the outer tub 5 has not been filled with water to a predetermined level within a predetermined time span during a filling process, a bar "—" and a letter "E" are displayed, as shown in FIG. 4 at (c), which means an inlet error. Additionally, the alphanumeric display device 27 is adapted to display a character "P" to indicate a temporary stop or pause, when the machine is not in the operating state. This display "P" is cleared by depressing the start button. Actuation of the pause button switch will of course generate the display of the temporary stoppage in the alphanumeric display device 27.

Referring to FIG. 1, there is provided in the console box 16*b* a control unit 37 which is adapted to control operations of the drive unit 7, the water supply system 30, the drain system 18, the alphanumeric display 27, the process display lamp array 28 and so forth in accordance with a predetermined program and to allow the processes of washing, rinsing and spinning to be carried out automatically. The control unit 37 may be implemented in the form of a micro-computer, a functional block diagram of which is shown in FIG. 5. As can be seen from this figure, the control unit 37 comprises a read-only memory or ROM 38, a random access memory or RAM 39, a program counter or PC 40, a stack register or STACK 41, an arithmetic logic unit or ALU 42, an accumulator or ACC 43, a timer 44, an interrupt control or INT 45, a clock generator 46, input devices 47 and 48, input/output devices 49 and 50, output devices 51, 52, 53, 54 and 55 and a data pointer. In FIG. 5, double-arrowed lines denote data buses and address buses.

The read-only memory or ROM 38 stores therein a program in accordance with which the washing machine is operated, conditions under which various decisions are made and rules for processing various information and instructions. For example, procedures and times for running the six operation programs selected by the full automatic operation selector switch array 22 are programmed in terms of combined instruction codes and stored in ROM 38.

The random access memory or RAM 39 serves to fetch data in the course of execution of the operation program to store therein. For example, the time required for filling the tub 4 with water to a predetermined level during the initial filling process is measured and stored in RAM 39.

The program counter 40 serves for addressing the program stored in ROM 38. The stack register 41 functions to latch the contents of the program counter 40 in response to a call for a sub-routine or a request for interruption processing. The timer 44 sets a time limit therein in accordance with a timer set instruction. The operation program stored in the read-only memory or ROM 38 is executed in accordance with the time limit as set in the timer 44. The interrupt control 45 serves to interrupt the execution of instruction in progress in response to the interrupt request and fetch other data. The clock generator 46 produces clock pulses for controlling timing of operations in the whole control unit 37. The arithmetic logic unit 42 serves for executing arithmetic operations, decisions or the like and constitutes the heart of the control unit 37 in cooperation with the accumulator 43 which is adapted to store the results of the arithmetic operation as well as the processed data. The symbol $C_1$ entered in the block representing the accumulator 43 indicates a carry flip-flop, while $C_2$ represents a carry reset flip-flop. The state $C_1$ of the carry flip-flop represents the presence or absence of a carry and a borrow upon addition and subtraction. For example, $C_1$ of logic "1" represents addition and subtraction with carry and borrow, respectively, while $C_1$ of logic "0" represents addition and subtraction without carry and borrow, respectively. Further, the carry reset flip-flop $C_2$ serves for temporarily retracting the contents of the carry flip-flop $C_1$ when an interrupt request has to be processed.

The input devices 47 and 48 as well as the input/output devices 49 and 50 receive at the inputs the signals from the full automatic operation program selector switch array 20, the buzzer switch 19, the start button switch 24, the pause button switch 25 and the power source main switch 21. The output devices 51, 52, 53, 54 and 55 supply control signals to the alphanumeric display device 27 and the process progress display lamp array 28. In more particular, the signals from the output devices 52, 53, 54 and 55 are supplied to a decoder 57, the output signals from which are then supplied to the alphanumerical display 27 or the process progress display lamp array 28 after having been amplified by a driver 58, as is shown in FIG. 6. The output signals from the input/output devices 49 and 50 are utilized for controlling the operations of the water feed valve 32, the drain valve 13 and the drive unit 7.

FIG. 7 shows an outer appearance of the control unit 37 with the array pattern of terminals. The signal terminals 120 and 141 are connected to a power supply source for driving the control unit 37. The signal terminals 137 to 140 and 133 to 136 are provided for the input devices 47 and 48. The signal terminals 108 to 111 and 102 to 105 are for the input/output devices 49 and 50. The signal terminals 112 to 115, 116 to 119, 122 to 125, 126 to 129 and 130 to 132 are provided for the output devices 51 to 55, respectively. The signal terminals 101 and 142 are connected to the clock generator 46. The signal terminal 106 is provided for receiving the request for interrupt processing. Numeral 107 represents a reset input terminal, while 120 represents a terminal for a test signal of the control unit 37.

As described hereinbefore, the liquid level in the outer tub 4 can be selectively set at three different levels $H_1$, $H_2$ and $H_3$ by means of the liquid level changeover knob 20. The liquid levels $H_1$, $H_2$ and $H_3$ are detected and confirmed by the pressure switch 34. More specifically, when a level L indicating an approximately completed drainage is attained, the output signal level of the pressure switch is changed over to a low level from a high level. On the other hand, every time when any one of the liquid levels $H_1$, $H_2$ and $H_3$ has been attained in the filling operation, the output signal level from the pressure switch 34 is changed over from the low level to a high level.

An example of the operation program selected by the button switch $S_1$ of the full automatic operation program selector switch array 22 is illustrated in FIG. 9. According to this program, the operation is carried out in a sequence of a washing process including a filling step and an agitating step, a spinning/rinsing process including a drain step, an intermittent centrifuging or spinning extraction step, a showering/spinning step and an intermittent spinning step, a water feeding and rinsing process including a water filling step and a water feeding (or pouring)/agitating step, and a spinning extraction process including a drain step and a continuous spinning step. With the term "agitation or agitating", it is intended to means that the washing liquid and the clothes or fabrics are agitated within the centrifuging and washing basket tub 5 through the rotation of the pulsator 6 with the tub 5 being held stationary. Further, the term "intermittent spinning extraction" or "intermittent spinning" is used to mean that the electric motor 8 is intermittently driven thereby to increase progressively the rotation number of the basket tub 5 in the drained state. The term "showering/spinning" is to mean that the basket tub 5 is rotated in the drained state with water being fed from the shower head 33. The term "feeding (or pouring)/agitating" is to means that only the pulsator 6 is rotated with the drain valve 13 having been closed, while water is being fed from the shower head 33, allowing water to overflow through the overflow outlet **4*b*. Finally, the terminology "continuous spinning" is used to mean that the washing and centrifuging basket 5 is continuously rotated in the drained state. The time for agitating step is set for 10 minutes. The first intermittent spinning time is set for 2.5 minutes while the second intermittent spinning time is set for 2 minutes. The continuous spinning time is set for five minutes. These time durations are complied in the operation program and stored in the read-only memory 38**.

The filling time durations T and $t_{1a}$, the drain time durations $t_2$ and $t_{2a}$, the showering/spinning time duration $T_1$ and the feeding/agitating time duration $T_3$ will vary in dependence on the available filling or feeding conditions or draining capabilities and thus can not be definitely determined. Such being the circumstance, the time duration or period T which is required for the first filling step, i.e. the time span between the start of filling tub 4 with water and the changing-over of the output signal from the pressure detection switch from the low to high level is measured and on the basis of this measured filling time T, the showering/spinning time duration $T_1$ at the spinning/rinsing process, the feeding time duration $t_{1a}$ at the feeding/spinning process and the feeding/agitating time duration $T_3$ in the feeding/rinsing process are arithmetically determined through operations in the control unit 37. Additionally, the time required for the initial drainage, that is the time span $t_2$ between the opening of the drain valve 13 and the change-over of the output signal from the pressure detecting switch 34 from the high to the low level is measured. On the basis of the measured time $t_2$, the drainage time duration $t_{2a}$ at the spinning step is determined through the arithmetic operations in the control unit 37. These measured and determined time durations T, $t_2$, $t_{1a}$, $t_{2a}$, $T_1$ and $T_3$ are stored in the random access memory 39.

Figure 10:
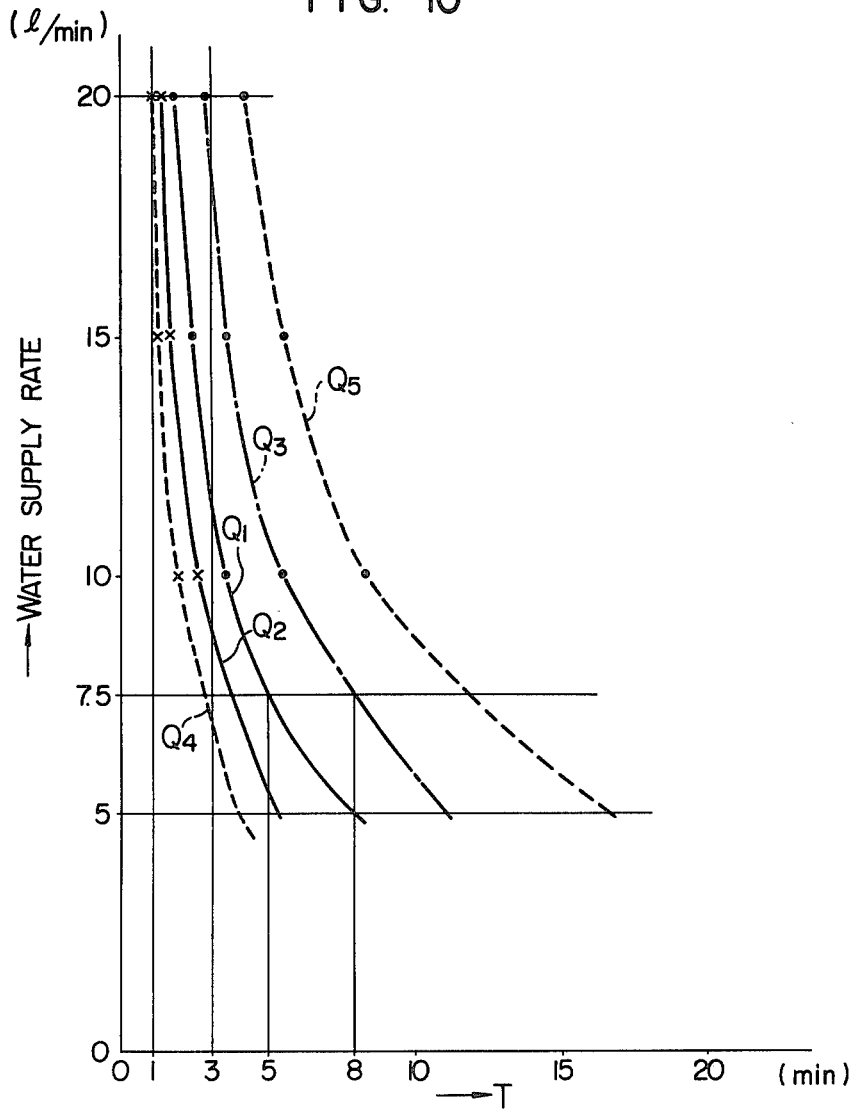
FIG. 10 illustrates graphically relations between water supply rates and times required for filling a tub to predetermined level.

The time T required for the initial or first filling step will undergo variations in dependence on the water supply rate (l/min) which can be obtained from an available water supply source as is illustrated in FIG. 10, in which a curve $Q_1$ represents a filling characteristic in the case where the tub 4 is filled with water to the liquid level $H_3$, a curve $Q_2$ represents a filling characteristic in the case where the tub is filled with water to the level $H_1$, a curve $Q_3$ represents a filling characteristic in the case where the tub is filled to the level $H_3$ and "a normal rinsing" is to be effected, a curve $Q_4$ represents a filling characteristic in the case where the tub 4 is filled to the level $H_1$ and "a spared rinsing" is to be performed, and finally the curve $Q_5$ represents a filling characteristic in the case where water has been supplied to the level $H_3$ for executing "strong rinsing".

In accordance with the characteristic curve $Q_1$, the time T required for filling the tub 4 to the water level $H_3$ may vary in the range of 1.8 to 7.4 minutes. In the case of the characteristic curve $Q_2$, the time T required to fill the tub 4 to the level $H_1$ may vary in the range of 1.3 minutes to 5.3 minutes. It has been experimentally established that the showering/spinning time $T_1$ may be set at one fourth of the filling time T to attain satisfactorily the spinning/rinsing action. Further, it has also been experimentally determined that the feeding/agitating time span $T_2$ has to be selected 1.5 times as long as the filling time T to accomplish satisfactorily the feeding/rinsing operation. Accordingly, when the showering/spinning duration $T_1$ is set at one fourth of the time T for filling to the liquid level $H_3$, the former may vary in the range of 0.45 minutes to 1.85 minutes and may vary in the range of 0.33 minutes to 1.33 minutes if the tub is to be filled to the liquid level $H_1$. On the other hand, when the feeding/agitating time $T_2$ is set for 1.5 times as long as the filling time T, the time $T_2$ may vary in the range of 2.7 to 11.1 minutes for filling the tub to the level $H_3$ and in the range of 1.95 to 7.95 minutes for filling the tub to the level $H_1$.

As can be seen from the filling characteristic curves $Q_1$ and $Q_2$, when the filling time T is within about 5 minutes, the water supply rate will be more than 7.5 (l/min), while for the filling time T exceeding beyond about 8 minutes, the water supply rate will be less than 5 (l/min). It is assumed that the automatic washing machine shown in FIG. 1 is designed on the basis of the water supply rate of 7.5 (l/min) so as to be capable of being used even at the water supply rate of 5 (l/min) at minimum.

In order to obtain the data for determining the water supply capability of an available water supply source from which the washing machine shown in FIG. 1 is fed with water, preset tub filling times $T_0$ and $T_4$ are selected to be equal to 8 and 5 minutes, respectively. On the other hand, the actual filling time T at the washing process is measured and compared with the preset times $T_0$ and $T_4$ in the control unit 37. As the result, when $T \geqq T_0$, the actually available water supply rate is judged to be less than 5 (l/min). When $T \leqq T_4$, the water supply rate is judged to be equal to 7.5 (l/min).

Further, with a view to determining an abnormally short filling time, a preset time $T_5$ is selected to be equal to 1 minute. On the other hand, the actual filling time T is measured at the filling step in the washing process. When the result of comparison between $T_5$ and T in the control unit 37 is that $T \leqq T_5$, it is determined that an abnormal filling process takes place. In such case, the showering/spinning time $T_1$, feeding (or pouring)/agitating time $T_3$ and the feeding/rinsing time $t_{1a}$ are arithmetically determined on the basis of a preset time $T_7$ stored in the read-only memory 38 instead of the actually measured filling time T. In the case of the illustrated embodiment, the preset time $T_7$ stored in the memory 38 is experimentally selected to be equal to 3 minutes. The preset times $T_0$, $T_4$, $T_5$ and $T_7$ are all stored in the read-only memory 38.

The water feeding or pouring time $T_3$ for the strong or forceful rinsing is preset 1.5 times as long as the feeding/agitating time $T_2$. For sparing rinsing, the feeding time $T_3$ is selected to be a half of the feeding/agitating time $T_2$. The water feeding time $T_3$ for a normal rinsing is selected equal to the feeding/agitating time $T_2$. The constants (0.5; 1.5) for setting the water feeding time $T_3$ for the strong and the sparing rinsing processes are stored in ROM 38.

When the filling time T at the initial filling process is longer than the preset time $T_4$, the progress display lamps 28 will be turned off, indicating that the water supply rate from a water supply source is inadequate (abnormality display). When the actual filling time T is longer than the preset time $T_0$, the buzzer is energized to alarm an abnormal water supply rate (abnormality alarm) and at the same time the water supply system 30 is shut down. After the cause for the abnormal water supply has been cleared, the water supply system 30 is actuated again by a manual reset means, thereby to start the filling process from the beginning. Comparison of the actual filling time T with the corresponding preset time $T_4$ and $T_0$ is performed in the control unit 37, whereby the generation of abnormality display and/or abnormality alarm and/or shut-down of the water supply system 30 is effected in accordance with the instructions from the control unit 37.

Figure 11:
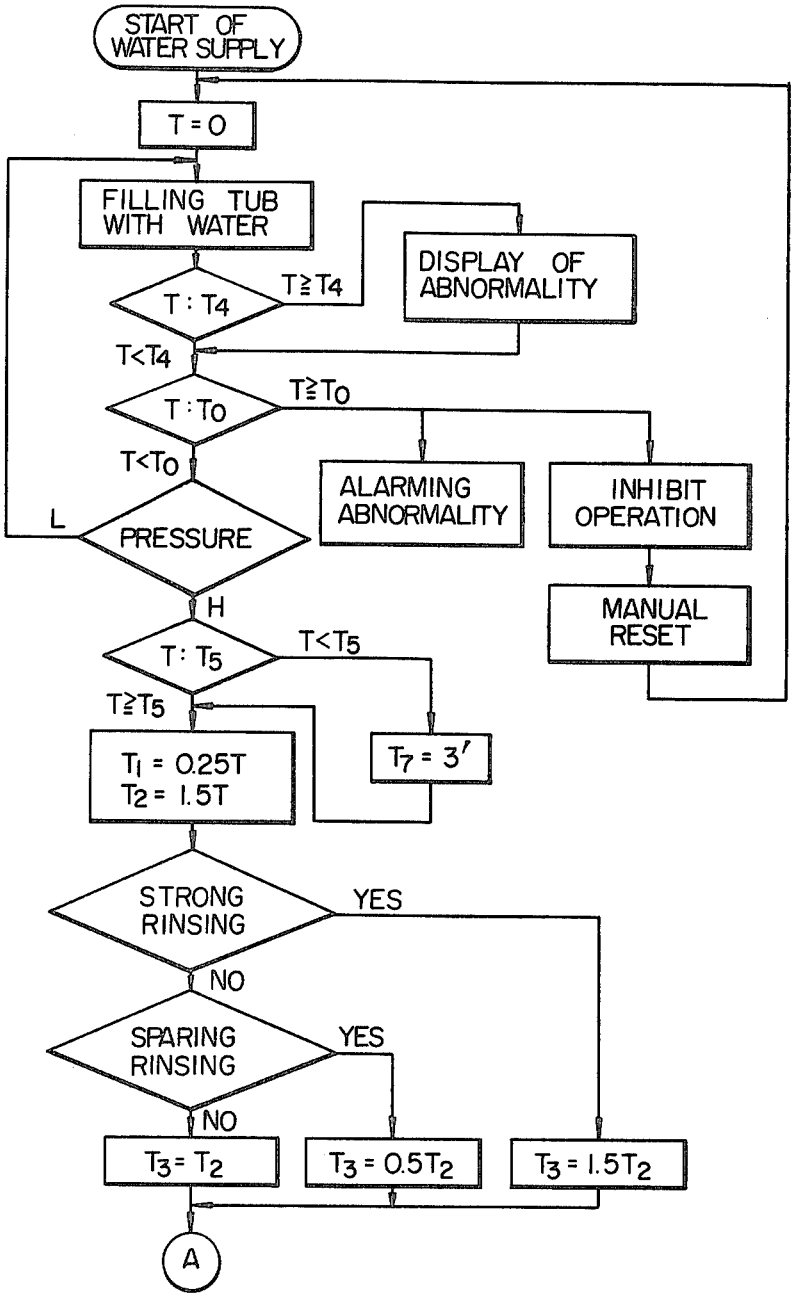
FIGS. 11 and 12 illustrate operations of the automatic washer shown in FIG. 1 in a flow chart starting from the initiation of water supply to the setting of a rinsing time.
Figure 12:
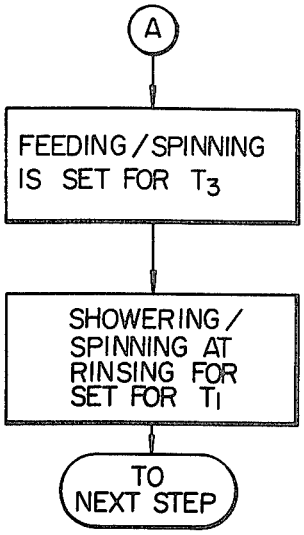

Next, the water supply operation of the full automatic washing machine of the construction described above will be concretely elucidated by referring to the flow chart shown in FIG. 11. In the first place, the main source switch 21 is turned on and at the same time the buzzer knob 19 as well as the level change-over knob 20 are set to respective desired positions (marks). Subsequently, the full automatic operation program selector switch array 22 and the programmed process selector switch array 23 are selectively operated to set a desired operation program.

The signals from the operated switches of the switch arrays 22 and 23 are applied to the input devices 48, 49 and 50 and recognized by the arithmetic logic unit 42, whereby a command for reading out the address of the set operation program is sent out to the program counter 40. In response to the command from the program counter 40, the contents of the set operation program are read out from the read-only memory 38 and supplied to the arithmetic logic unit 42, as the result of which an appropriate operation command is output through the accumulator 43. For example, when the button $S_1$ is depressed, all of the twelve progress display lamps 28 are turned on, while a character "P" is displayed at the alphanumeric display device 27 to inform the operator of the operation program being halted.

For initiating the execution of the operation program, the start button 24 is depressed. Then, the arithmetic logic unit 42 is released from the pause state and a numerical display such as "28 minutes" for example is produced at the display device 27, while at the same time a signal for opening the water supply valve 30 is produced from the input/output devices 49 and 50, thereby to initiate the filling step at the washing process.

When the valve 32 is opened and the outer tub 4 is filled with water to a predetermined level (e.g. level $H_3$) selected by the level selector knob 20, the signal from the pressure switch 34 is turned from the low level to a high level.

The filling time span T between the initiation of water supply and the change-over of the pressure switch signal to the high level is measured and stored in the random access memory 39.

If the failure of water supply such as suspension and freezing happens or if a cock of a water service pipe should be accidentally left as it was closed, no water is supplied to the washing machine. Namely, the outer tub 4 will be never filled to the level $H_3$. The same applies to the case where a significant leakage of water occurs through the drain valve 13 or other portions.

In such abnormal cases as described above, a water supply inhibit signal is produced from the control unit 37 to close the water feed valve 30 and turn off the progress display lamp 28. More particularly, the preset times $T_4$ and $T_0$ read out from the read-only memory 38 is compared with the measured filling time T by the arithmetic logic unit 42. When it has been determined that $T_4 \leqq T$, the progress display lamps 28 are turned off by the signals output from the output devices 52, 53, 54 and 55. Further, when it is additionally determined that $T_0 \leqq T$, an operation inhibit signal is produced from the input/output device 49 and 50 to stop the operation of the water supply system 30. Simultaneously, the buzzer is energized by the abormality signal to alarm the operator of a prevailing abnormal situation.

When the failure (abnormality) of the water supply has been removed, a reset signal is supplied to the signal terminal 107, as the result of which a restoring signal produced from the control unit 37 causes the water supply system 30 to re-start the operation thereof. When the tub 4 is filled with water to the predetermined level, the high level signal from the pressure switch 34 is applied to the input devices 47 and 48, which then gives rise to the generation of the water supply stop signal from the input/output devices 49 and 50 thereby to stop the operation of the water supply system 30. On the other hand, the actually measured filling time T is compared with the preset time $T_5$ at the arithmetic logic unit 42. If $T < T_5$, then the preset time $T_7$ is read out from the read-only memory 38 and the showering/spinning time $T_1$, the water feeding $t_{1a}$ at the feeding/rinsing step and the feeding/agitating time $T_3$ at the feeding/rinsing step are arithmetically determined on the basis of the read out time $T_7$ in place of the measured filling time T. On the contrary, when $T \geqq T_5$, the times $T_1$, $t_{1a}$ and $T_3$ are determined on the basis of the actually measured filling time T. These determined times $T_1$, $t_{1a}$ and $T_3$ are stored in the random access memory 39 in any case.

When the high level signal from the pressure switch 34 is applied to the input devices 47 and 48, a drain initiating signal is produced from the input/output devices 49 and 50 to actuate the drain system 18. When the water level in the outer tub 4 is lowered to the level $H_0$ in the course of drainage, the signal from the pressure switch 34 is changed over to the low level from the high. This low level signal applied to the input devices 47 and 48 will cause the drain stop signal to be produced from the input/output devices 49 and 50 to stop the drain operation. The time elapse until the change-over of the signal from the pressure switch 34 to the low level from the high is measured by the arithmetic logic unit 42 and stored in the random access memory 39 as the drain time $t_2$, on the basis of which the drain time $t_{2a}$ at the spinning step is determined. The value of $t_{2a}$ is also stored in the random access memory.

The time values $T_1$, $t_{1a}$, $T_3$, $t_2$ and $t_{2a}$ are sequentially read out in accordance with the contents of the operation program read out from the read-only memory 38 to carry out the rinsing process and the spinning or centrifuging extraction process.

As will be appreciated from the foregoing description, the showering/spinning time $T_1$, the water feeding time $t_{1a}$ and the feeding/agitating time $T_3$ at the feeding/rinsing process can be automatically determined in the control unit 37 on the basis of the filling time T at the washing process, while the drain time $t_{2a}$ at the drain process can also be automatically determined in the control unit 37 on the basis of the drain time $t_2$ succeeding to the completed washing process. Further, if the filling time T at the washing process is extremely short, the showering/spinning time $T_1$, the water feeding time $t_{1a}$ and the feeding/agitating time $T_3$ will be automatically determined in the control unit on the basis of the preset time $T_7$, the value of which is selected so as to assure a satisfactory rinsing action. Accordingly, even when the washing machine according to the invention is used in a region where water pressure in the water service pipe is at a high level, adequate rinsing action can be assured without involving an extremely short time for the rinsing process. Additionally, even if the actually measured filling time T at the washing process is extremely short because of a batch supply of lukewarm water or the like by a bucket to the outer tub 4, an adequate rinsing action can be accomplished without involving abnormally short rinsing time.

In the case of the illustrated embodiment, it has been assumed that the rinsing process consists of the spinning/rinsing step and the feeding/rinsing step. However, this rinsing process may consist of a spinning/rinsing, a storing/rinsing and a feeding/rinsing. With the term "storing/rinsing", it is intended to mean that the rinsing is effected by rotating the pulsator 6 in the state in which water is stored in the outer tub to a predetermined level with the drain valve 13 being closed.

Figure 13:
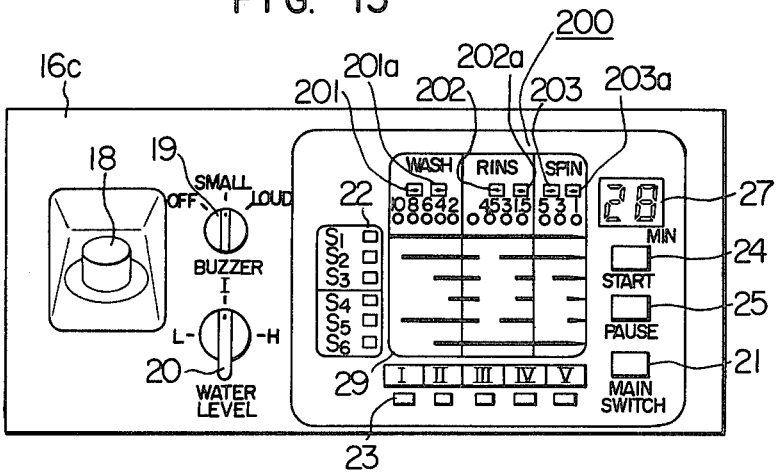
FIG. 13 is a top plan view of a console panel according to another embodiment of the invention.

Further, in the case of the illustrated embodiment, the time duration for the aditating step at the washing process, the intermittent spinning time at the spinning/rinsing step and the continuous spinning time duration for the drain process are invariable. However, it is possible to make these time durations to be variable by providing a time varying switch array 200, as is shown in FIG. 13. More specifically, buttons 201 and 201*a* are provided for varying the agitating time duration for the washing process, buttons 202 and 202*a* are to serve for varying the intermittent spinning time duration for the spinning process, and the buttons 203 and 203*a* serve for varying the continuous spinning time for the spinning process. The signals produced through manipulations of these button switches 201; 201*a*, 202, 202*a* and 203; 203*a* are supplied to the control unit 37 and utilized by the arithmetic logic unit 42 for changing or modifying the agitating time, intermittent spinning time and the continuous spinning time. It should be mentioned that the buttons 201, 202 and 203 attached with an arrow directed to the left are for extending the time durations, while the buttons 201*a*, 202*a* and 203*a* are for shortening the associated time durations.

As will be appreciated from the foregoing description, the present invention has now provided an automatic washing machine which is capable of effecting the rinsing operation adequately, even when the initial filling time require for filling the tub with water at the start of the washing operation should be abnormally short.

What we claim is:

1. An automatic washing machine, comprising an outer housing, an outer tub supported in said housing, a spinning and washing tub rotatably supported in said outer tub, a rotatable wing member for agitating water contained in said spinning and washing tub, drive means for actuating said rotatable wing member at washing and rinsing processes and for rotating said spinning and washing tub at spinning process, a water supply system for supplying water to said outer tub, a water drain system for draining water from said outer tub, storage means for programming and storing operating time durations and operating sequence of said drive means, said water supply system and said water drain system or combinations thereof, means for selecting a desired program from those stored in said storage means, control means for controlling operations of said drive means, said water supply system and said water drain system in accordance with said selected program thereby to effect the washing, rinsing and spinning processes, and means for measuring a filling time required for filling said outer tub with water to a predetermined level at the start of said washing process and arithmetically determining a water feeding time duration for said rinsing process on the basis of said measured filling time, wherein said water feeding time duration at said rinsing process is determined on the basis of a preset rinsing time duration stored in said storage means when said measured filling time is abnormally short.

2. An automatic washing machine as set forth in claim 1, wherein said rinsing process includes a rinsing step with spinning and a rinsing step with water feeding.

3. An automatic washing machine as set forth in claim 1, wherein said program selecting means is disposed in a console panel provided at a top plane of said housing.

* * * * *